United States Patent [19]

Cozzens et al.

[11] Patent Number: 4,793,822

[45] Date of Patent: Dec. 27, 1988

[54] SCREW SLOT CONNECTOR

[75] Inventors: Brian E. Cozzens, Mechanicsburg, Pa.; William R. Evans, Mooresville, N.C.; Wayne E. Kleiner, Mohrsville, Pa.

[73] Assignee: AMP Incorporated, Harrisburg, Pa.

[21] Appl. No.: 164,943

[22] Filed: Mar. 7, 1988

Related U.S. Application Data

[63] Continuation-in-part of Ser. No. 114,183, Oct. 28, 1987, abandoned.

[51] Int. Cl.[4] ..... H01R 4/24

[52] U.S. Cl. ..... 439/397; 439/412

[58] Field of Search ..... 439/411–417, 439/428, 429, 431–433, 443, 778, 781, 790, 791, 793–795, 797, 798, 801, 807, 810–814, 425

[56] References Cited

U.S. PATENT DOCUMENTS

| | | | |
|---|---|---|---|
| 2,267,449 | 12/1941 | Eby | 439/411 |
| 3,075,164 | 1/1963 | Humpage et al. | 439/814 |
| 3,210,818 | 10/1965 | Wallshein | 439/778 |
| 3,877,773 | 4/1975 | Doty et al. . | |
| 3,897,993 | 8/1975 | Fleischhacker et al. . | |
| 4,186,984 | 2/1980 | Reavis, Jr. et al. . | |
| 4,645,285 | 2/1987 | Cozzens et al. . | |

FOREIGN PATENT DOCUMENTS

| | | | |
|---|---|---|---|
| 3150568 | 2/1983 | Fed. Rep. of Germany | 439/412 |
| 103319 | 6/1924 | France | 439/807 |
| 2529021 | 12/1983 | France | 439/416 |

*Primary Examiner*—David Pirlot

[57] ABSTRACT

An electrical connector (24) terminates a conductor wire (18) through a conductive terminal (24) having a slot (54) which operates to strip and terminate the conductor wire as pushed therein by a plastic screw element (26) internally threaded (34) to mate with external threading (42) on the terminal, the plastic screw element being driven manually or by a tool such as a screwdriver to effect termination. Sealing can be provided by injecting insulation material (144) following termination and alternative versions include self tapping screw threads (120) and a separate IDC terminal (150).

7 Claims, 4 Drawing Sheets

SCREW SLOT CONNECTOR

This application is a Continuation-in-Part of application Ser. No. 114,183, filed Oct. 28, 1987, now abandoned.

This invention relates to an electrical connector for terminating conductive wires through the cooperation of a threaded plastic screw element and a threaded and slotted terminal insulation displacement connector (IDC) concept.

BACKGROUND OF THE INVENTION

In premise or field wiring of buildings and facilities such as for telephone, computer and various business machine interconnections, a wide variety of techniques are employed. These include crimping employing an electrical terminal crimped to the wire, usually with a precision tool; soldering wherein the wire is soldered to a terminal employing a soldering tool, appropriate flux and appropriate solder and skill; screw down terminals wherein a stripped wire is trapped beneath a screw mounted on a terminal block and manipulated typically with a screwdriver; and by employing the IDC concept wherein the wire is driven into a slot in a metal member arranged to strip the insulation from the wire and provide a gas type seal of the conductor through deformation thereof with spring elements elastically deformed by wire insertion. All of these techniques have their advantages and disadvantages relating to quality of termination, speed of termination or productivity potential and the cost of labor, terminal and tool. As a general rule, screw down terminals have been widely used in the field where relatively few are done at a time as contrasted with the factory where many terminations are done per shift. This preference is tied to the limited availability of special tools to contractors and craftsmen responsible for wire and component installation; all of them having readily available screwdrivers, pliers, nippers and the like, the use of which is not only necessary for component installation but obvious and well understood as compared with special crimp, solder or IDC tools. Despite this preference, the screw-down termination has its shortcomings, particularly with respect to a determination of whether or not a given screw termination has been turned down sufficiently tight to adequately compress the wire and store elastic energy within the screw and in the wire so as to effect an adequate and long term termination. A screw down fitting may be readily not turned down tight enough or alternatively, turned down so tight that wire damage can be done leading to excessive deformation and breakage. Of the various techniques employed, the IDC concept which utilized the displacement of a wire into a slot of a contact spring system tends to eliminate the potential for under or over deformation of the wire.

Thus it is by way of background that the objective of the present invention is to provide the controlled deformation of a conductor wire including insulation stripping employing the IDC concept in conjunction with a screw down fitting. It is a further object of the invention to provide a connector and termination concept allowing the use of simple tools such as screwdrivers for field termination of conductor wires while providing a degree of certainty built into the termination mechanism to result in an improved field termination of conductor wire. Finally, it is an object of the invention to provide a screw down type IDC termination particularly adapted for use in the field.

SUMMARY OF THE INVENTION

The present invention achieves the foregoing objectives by providing in one embodiment a tubular IDC terminal with the tubular portion thereof embossed to form threading in conjunction with a cap element internally threaded to mate with such threading on the terminal and adapted to be screwed thereon to force a conductor wire inserted into such terminal to be driven downwardly into a slot defined in the exterior wall of the terminal. The slot is in a preferred embodiment tapered so as to accommodate a wide range of conductor wires, the larger gauges in the upper regions of the slot and the smaller gauges in the lower regions thereof. A variety of cap elements are contemplated for use with the aforesaid terminal, such elements being dimensioned to accommodate a limited range of wire gauges by in essence having wire engaging surfaces arranged to push a given wire a given distance in the terminal slot as controlled by the interior of the cap bottoming on the upper surface of the terminal. The threaded cap element includes in a preferred embodiment a slot to accommodate a tool such as a screwdriver, it being contemplated that other shaped surfaces may be employed to effect rotation of the screw element manually such as by the use of a wing nut geometry for finger operation or Allen, hex or Phillips head matching surfaces in lieu of the standard screwdriver slot.

The terminal includes in a preferred embodiment a projecting tail portion adapted to be soldered to a printed circuit board, to the conductive trace thereon following insertion through an aperture in such printed circuit board.

In an alternative embodiment, the tubular IDC terminal is internally threaded, and the screw element is externally threaded to effect wire displacement. Alternative versions also contemplate apertures in the cap element to facilitate injection of a ceiling elastomer or grease for exterior environments.

A further alternative embodiment includes a self tapping tubular IDC terminal, and finally an embodiment having a three piece assembly, cap and a tubular threaded member which houses a flat IDC terminal as a third element.

DETAILED DESCRIPTION OF THE INVENTION

Figure 1:
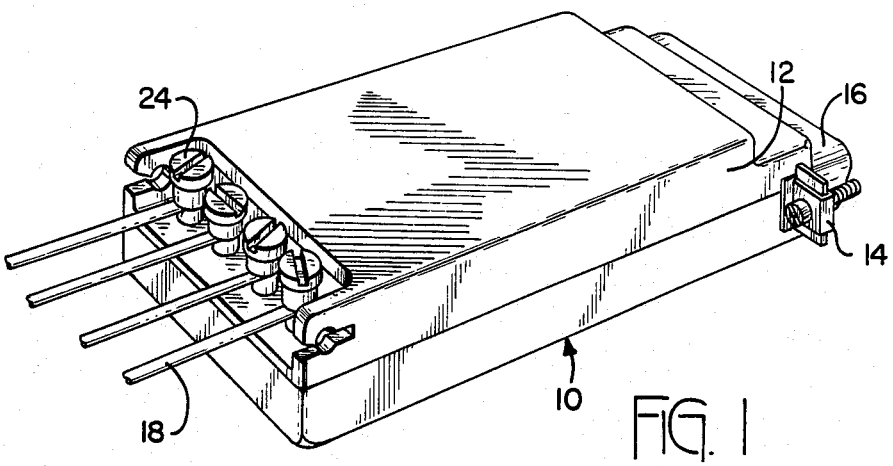
FIG. 1 is a perspective showing an electronic component terminated to four conductive wires through the use of four terminals in accordance with the invention.

FIG. 1 depicts an electronic component 10 which may be taken to represent a wide variety of electronic devices employed to code, decode, multiplex, provide protocol adaptation, or serve as modems or the like in electronic communication systems. The unit actually shown in FIG. 1 represents a modem device intended to interconnect remote or distributed computers and/or the terminals thereof with a central or mainframe computer or portions thereof. The device which is shown roughly to scale, includes a plastic outer body 12 having mechanical fasteners 14 at one end adapted to connect the device to a computer via a connector shown as 16 which may be typically an RS232 interface or other appropriate interface, the mating half which may be found on the rear of many computers, Electrical signal, power and grounding inputs are provided via conductor wires shown as 18 terminated by the invention connectors 24. As can be seen, the connectors appear to be screw down devices having screw tops much like those employed in a conventional manner in premise wiring, except that the invention features plastic screw caps on the preferred embodiment. Indeed, it is the intention and effect of the present invention to visually present a termination which appears familiar to the craftsman installing conductor wires into devices like 10. The craftsman physically inserts one of the conductor wires 18 into the device 24 and thereafter screws the upper portion thereof in a manner to be hereinafter described down with the screwdriver, terminating the conductive portion of wire 18 thereto.

Figure 2:
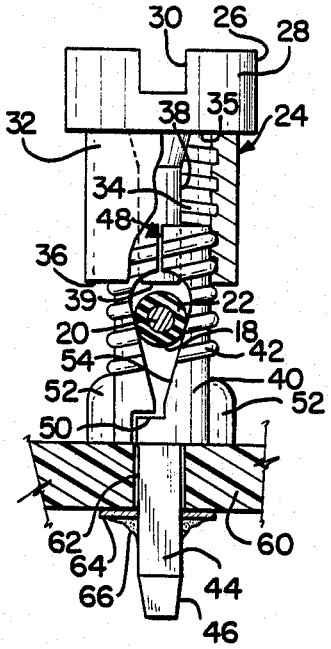
FIG. 2 is an elevation of one of the terminals of FIG. 1, much enlarged from actual size, and including in partial section details showing the terminal connector of the invention having a wire inserted therein but prior to actuation.

Referring now to FIG. 2, the invention connector 24 is shown considerably enlarged from actual size which may range between one fifth and one third of the size shown in FIG. 2. Connector 24 may be seen to include a screw cap element 26 which is molded of insulating and dielectric material such as nylon chosen from electrical grade materials widely available as engineering plastics from a wide variety of sources. The screw element 26 is preferably of one piece, made to include a head portion 28 slotted as at 30 with a lower projecting sleeve portion 32 internally threaded as at 34, up through the sleeve portion to an internal face shown as 35 which bottoms or closes with a top of the connector terminal to limit downward displacement of the screw cap element. Interiorly of the sleeve portion 32 and projecting therealong is a stuffer rod shown as 38 in FIG. 2 which engages the conductor wire in the center of the connector to provide an adequate displacement of the wire for termination in the slot of the connector terminal. The terminal is shown as element 40 to include an upward tubular portion threaded as at 42 to mate with the threading 34 of the screw element 26. Terminal 40 includes a projecting portion 44 beveled as at 46 as shown in FIG. 2 and adapted to be inserted into a printed circuit board shown as 60 in FIG. 2. The printed circuit board 60 includes an aperture 62 and on the lower surface thereof, a conductive trace 64 suitably soldered as at 66 to the projecting portion 44 of terminal 40. The tubular portion of terminal 40 is split as at 48 in the upper end and as at 50 in the lower end to allow radial flexure of the terminal to accommodate wire termination through developing an elastic spring force in the manner disclosed and described in U.S. Pat. No. 3,860,318, filed Jan. 14, 1975, in the name of R. Reavis et al. Terminal 40 is also made to include embossments or projections shown as 52 which tend to stabilize the terminal and provide additional vertical support therefore. Terminal 40 also includes a tear shaped slot 54 which is tapered as shown to accommodate a range of conductor wires.

In FIG. 2, a conductor wire 18 including a center core 20 and an insulation covering 22 is shown positioned within the tapered slot 54. The dimensions of slot 54 include an upper relatively wide portion adapted to receive conductor wires inserted therein and dimensioned to provide clearance for the largest wire size which may be used with the connector and tapering into a smaller dimension as the slot approaches the bottom of the connector terminal. The principles of slot tapering to accommodate a wide range of conductor wires is taught in U.S. Pat. No. 4,116,522, filed Sept. 26, 1978, and issued to C. F. Reynolds.

Figure 3:
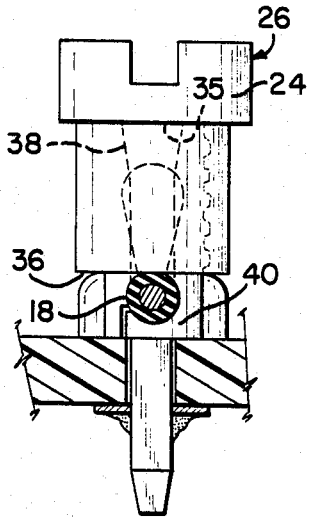
FIG. 3 is a view of the connector of FIG. 2 following actuation to effect termination of a conductor wire inserted in the connector of the invention.

FIG. 3 shows the connector 24 with the screw element 26 actuated by rotation as through a screwdriver inserted in the slot 30 to drive the conductor wire 18 downwardly until the top of the connector terminal 40 engages the interior surface 35 of element 26 as indicated in phantom in FIG. 3. As can be seen in FIG. 3, also in phantom, the stuffer rod 38 via an end surface 39 pushes the wire interiorly of the terminal with the surface 36 of the cap pushing the wire exteriorly of the terminal, the two surfaces working together to force the wire 18 downwardly in a vertical sense and relatively parallel to the surface of PC board 60. In accordance with IDC principles, particularly as detailed in the aforementioned U.S. Pat. No. 3,860,318, the terminal will be displaced sufficiently to store energy in an elastic sense with the edges of the slot penetrating the insulation 22 to engage and deform the conductor wire 22 slightly but sufficiently to scrub clean fresh conductive surfaces and maintain a gas tight seal of said surfaces in engagement with the surfaces of the terminal formed by the edges of the slot into which the wire is forced. In accordance with the invention concept, the screw cap element 26 will in every instance be bottomed out so that there is no question in the mind of the craftsman installing wires utilizing the connectors of the invention as to when sufficient rotation of the cap has been effective, instructions being to turn the element down until it bottoms.

Figure 4A:
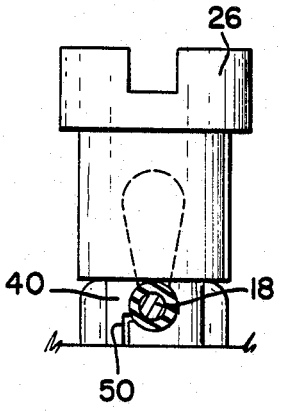
FIGS. 4A, B, and C are elevations of the connector of the invention utilizing screw elements of different heights to effect termination of conductor wires of different sizes, the figures showing in order termination of small, medium and large wire gauges, respectively.
Figure 4B:
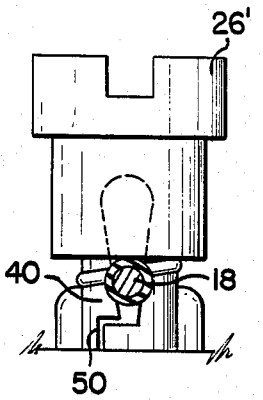
Figure 4C:
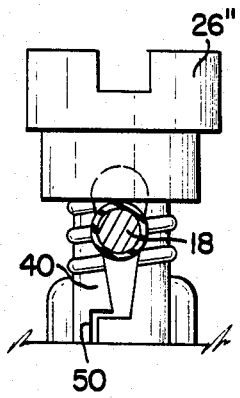
Figure 5:
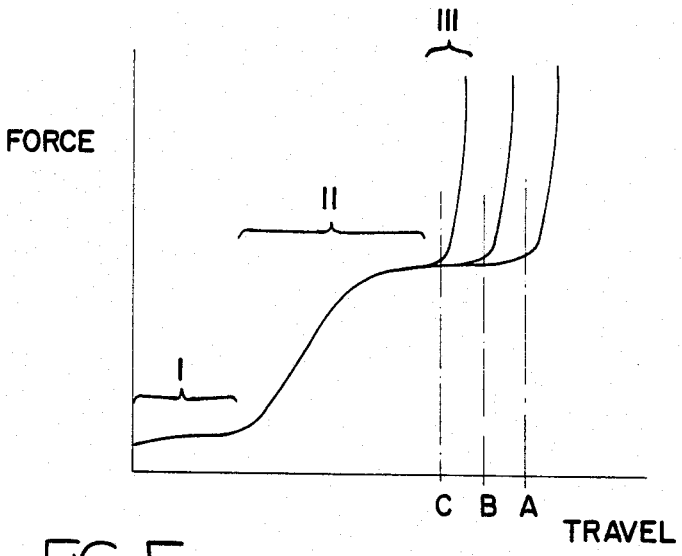
FIG. 5 is a diagram showing force versus displacement characteristics for each of the connectors shown in FIGS. 4A, 4B, and 4C, respectively.

This feature of the invention is shown best in FIGS. 4A-4C and in FIG. 5. In FIG. 4A, the invention connector utilizes a screw element 26 as is indicated in FIG. 3 to terminate the smallest gauge wire suitable for use with the invention, such wire shown as 18 as terminated in the terminal 40 of the connector. FIG. 4B shows a similar view utilizing a second element 26' adapted to terminate the midrange gauges of wire 18' FIG. 4C shows a third element 26" adapted for use with a large gauge of wire 18". As can be discerned from FIGS. 4A–4C, in each instance the upper surface of the terminal 40 bottoms against the interior surface 35 of the elements 26, 26, and 26" in the manner heretofore described. Also shown in FIGS. 4A–4C is the displacement accorded each different wire range size by virtue of the movement of the IDC slot shown through the disposition of the separation as at 50 in FIGS. 4A–4C. These separations are exaggerated in the showing, in actual practice the difference in displacement between the smallest and largest wires range between several thousandths of an inch and less than 20 thousandths of an inch, it being pointed out that the different wire gauges are forced to reside in different levels of the terminal slot in accordance with the tapered concept. In this regard, it is important that the shape and depth of the internal threads 34 of element 26 be dimensioned relative to the depth and exterior dimension of the threads 42 of terminal 40 so that there can be slight but sufficient radial movement outwardly of the terminal upon the wire being driven downwardly within the slot to expand the terminal and effect the elastic deformation thereof necessary to maintain a permanent and lasting termination with the wire.

FIG. 5 shows a force travel curve, the ordinate representing force required to rotate the screw element 26 and the abscissa representing travel of the element 26 in rotation downwardly to drive the wire 18 within the slot of the terminal. Each of the curves shown as A, B, and C correspond to the terminal embodiments of FIGS. 4A, 4B, and 4C and to, for example, three ranges of wire gauges acceptable with such terminals as modified by the different screw elements. In FIG. 5 the portion of the curve represented as I relates to the first increment of displacement of the wire where little work is being done; the second segment II representing insulation stripping and wire deformation; and III representing bottoming of the interior surface 35 against the top surface of the terminal. As can be discerned from FIG. 5, the stopping point is readily ascertainable by craftsmen manipulating the screw element through a screwdriver or other such tool or by hand, the force in essence rising instantly and rapidly to a point of destruction of the materials of which the connector, cap and terminal are made. For all intents and purposes, the zone III represents a tactile feel which is clear and positive.

In accordance with the invention, the several screw elements in their various geometries representing different ranges or wire gauge accommodated by the connector of the invention may be signified by having the elements of different numbers or colors such as red, blue and yellow, colors associated with wire gauge ranges in the traditional crimp type terminals where a given color represents an accommodation of at least two wire gauge ranges. The three structures shown in FIGS. 4A–4C may be made, for example, to accommodate three sets of wire ranges such as 26–28 AWG, 22–24 AWG, and 18–20 AWG; the range of gauges typically used for interconnection or signalling, ground, low power or other electronic circuit requirements.

In practice, the terminal 40 may be made of an appropriately hardened brass or phosphor bronze suitably stamped and formed into shapes like that shown and suitably tin plated throughout the barrel portion and adapted for use with solid or low count stranded wire preferably suitably tin plated of copper and insulated typically with polyvinyl chloride or polypropylene insulating coatings.

Figure 6:
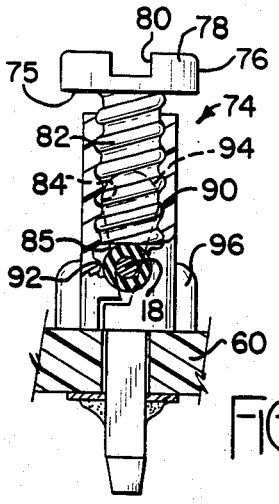
FIG. 6 is an elevation, in partial section, showing an alternative embodiment of the connector of the invention.

Referring now to FIG. 6 an alternative embodiment of the invention is shown in the form of a connector assembly 74. The connector 74 includes a plastic screw 76 having a head as at 78 in FIG. 6 slotted as at 80 to accommodate the insertion of a tool such as a screwdriver in the manner heretofore described. The screw element 76 includes a lower projecting portion 82 exteriorly threaded as at 84 and ending in a horizontally disposed surface 85. Connector 74 further includes as a terminal element 90 embossed to contain threads interiorly thereof shown as 92 which mate with the exterior threads 84 of the screw element 76. The terminal 90 further includes a slot in one side thereof shown as 94 tapered as in the heretofore described embodiment. Proximate the terminal engagement with the upper surface of a printed circuit board 60 are embossments shown as 96 to provide vertical support for the terminal and as is indicated in FIG. 6, a wire 18 is shown terminated in the lower portions of the slot 94.

Upon rotation of the screw element 74, the mating threads 82 of the screw element and 92 of the terminal element will result in the end face of the screw shown as 85, pushing the wire 18 downwardly effecting a termination of the wire to the terminal. Threading and rotation of the screw element will continue until the surface 75, the undersurface of the head 78 engages the top of the terminal element where upon the tactile feel and force travel characteristic heretofore described in FIG. 5 will result. As with the cap embodiments of FIGS. 4A–4C, it is contemplated that screws of different dimension, principally in the length of the threaded portion 82, may be employed to accommodate different ranges of wire sizes with such different screw elements having different colors or other connotations signifying the appropriate wire range size. It has been found that with the embodiment of FIG. 6, it is frequently necessary to press upon the exterior portion of wire 18 as the threading is accommodated by rotation of the element 76, pushing upon the wire on one side only of the IDC tubular element, tending to cock the wire as it is driven downwardly. A light pressure upon the exterior portions of the wire will essentially preclude this cocking and result in an effective termination thereof.

With the various embodiments it is contemplated that various means can be employed to provide cap or screw rotation in lieu of the standard screw drive slot 30 or 80 heretofore shown. For example, the cap 26 or screw 76 could be made with the well known wing nut features for direct hand manipulation. Or, alternatively, the cap or screw elements could be provided with Allen or Phillips or hex headed features for use with appropriate tools.

Figure 7:
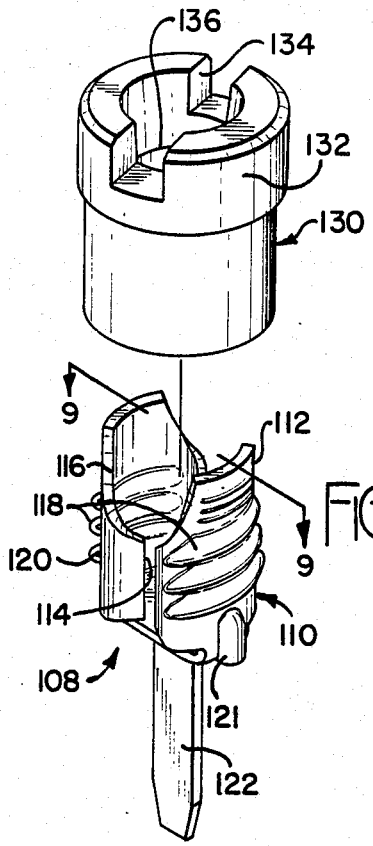
FIG. 7 is a perspective of an alternative embodiment showing the cap element and the threaded terminals elements separated prior to assembly.

Referring now to FIG. 7, there is as shown in an exploded view a two piece version of the connector of the invention 108 which can be seen to have a terminal element 110 and a screw cap element 130. The terminal body 110 is stamped and formed of a suitable conductive sheet material as with the other earlier embodiments in this application to include two distinct sides labeled 112 which are formed upwardly to define wire receiving and stripping slots 114, see the section revealed in FIG. 9. As can be discerned, the material of the terminal is formed inwardly of the generally tubular configuration so that the edges of the slots 114 reside well within the volume of the terminal for reasons which will be made apparent. Extending around the exterior surface of terminal 110 are a series of threads 118, at least two in number, which, at the leading edges, are perforated as at 120, referring to FIGS. 7–9 and made sharp and cutting to effect in essence a self tapping operation.

Figure 8:
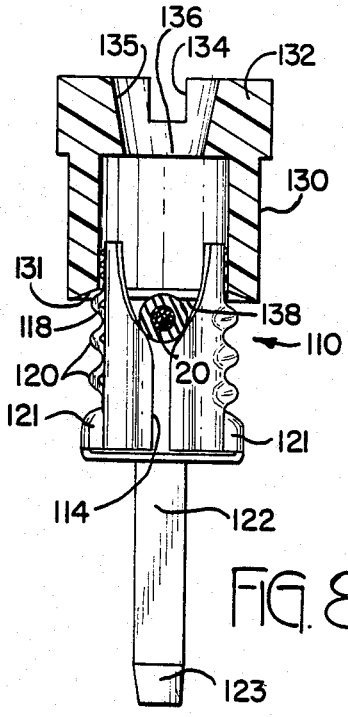
FIG. 8 is an elevational view of the elements of FIG. 7 assembled, but prior to actuation for termination.
Figure 10:
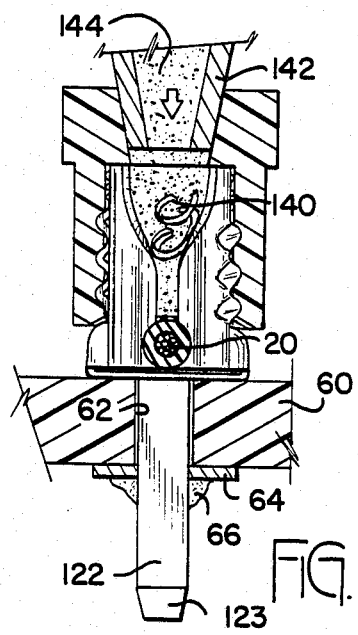
FIG. 10 is a view of the assembly of FIG. 8 in an actuated condition terminating a conductor wire, and additionally, in section showing the injection of an elastomeric material therewithin.

Toward the base of the tubular portion of 110 are embossments 121 which are made to extend beneath the base of the terminal and into the side walls to provide a stiffness tending to resist an opening up of the slots 114 upon the insertion of a terminal. These embossments 121 further serve to help stabilize the terminal as mounted in a printed circuit board in the manner shown in FIG. 10. There is provided a tang or blade 122 projecting from the base of the terminal 110 and ended in a beveled portion 123 which facilitates insertion within a printed circuit board. FIG. 10 shows the method of termination typically employed relative to a printed circuit board 60, an aperture therein 62, a conductive trace 64, and solder 66 which joins the terminal 110 to the trace 64 via the blade 122. Referring back to FIGS. 7 and 8, the screw or cap element associated with this embodiment shown as 130 includes a head 132 having a slot 134 therein, and in addition, a beveled portion shown as 135 ending in an aperture 136 leading to the interior of the cap element 130. As indicated in FIG. 8, the interior of 130 is in this embodiment preferably unthreaded to define a hollow and tubular interior space. The bottom end of 130 is interiorly tapered or beveled as at 131 to facilitate insertion of the element 130 onto element 110.

Figure 9:
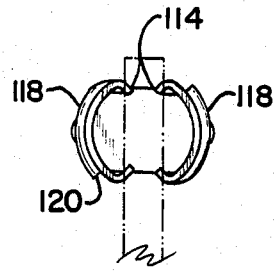
FIG. 9 is a section taken through lines 9—9 of the terminal of FIG. 7.

In practice, the terminal 108 is supplied in an assembled condition with the cap element 130 positioned as shown in FIG. 8. In use, the terminal is typically soldered during production of the electronic assembly, typically through flow wave or phase soldering, although in certain instances, such may be done by hand; the connection 108 to the board 60. Thereafter and at a later time, either in assembly of subcomponents or in the field as in premise wiring, in the manner indicated in the early description to FIG. 1, electrical wire 18, typically having a core 20 of copper stranded wires surrounded by an insulating coating 22 is inserted through connector 108 in the opening provided by the upstanding portions of elements 112. This is shown in FIG. 8. Following insertion of the conductor wire 18, the cap element 130 may be actuated by the use of a screwdriver pressing down into slot 134 and suitably rotated. As this occurs, the cap will be driven into engagement with the self tapping threads 118 which will bite into the interior of cap element 130. Rotation of 130 will continue until the cap in essence bottoms the ends engaging the projections 121 and the interior of the head portion 132 engaging the tops of elements 112. At this time, the wire 18 will have been driven well into the slot 114 in the manner shown in FIG. 10. It is contemplated that a wire may be passed completely through the terminal 108 so that it may be connected to other circuits through other terminals or connectors, possibly like that evidenced in this application. Alternatively and optionally, the wire may be terminated as indicated in FIG. 9 with the end thereof proximate the edge of the terminal 108.

During the application just described, the sharp edges 120, in conjunction with the rotation under axial pressure of the cap element 130, can effect a scything of the interior material of 130, which will then pass through 120 and to the interior of the connector assembly. Such scything is shown in FIG. 10 as 140.

FIG. 10 also reveals an added concept of the invention wherein the cap element is provided with means via the tapered portion 135 and aperture 136 for the injection of a dielectric material to the interior of the connector 108. This step is revealed in FIG. 10, the end portion of a nozzle 142 being forced into the tapered and funneled shaped surface 135 of the cap element 130. The dielectric material 144 is shown flowing through 142 to fill the interior of 108, excluding, as it fills, air from therewithin and flowing into the interstices defined by the interior surface of the terminal 110 in and around the conductor wire 18 to effectively seal the IDC terminations. It is contemplated that the dielectric material may be selected in certain applications from a variety of greases utilized in conjunction with electrical terminations, particularly if the connector 108 will require disassembly at a later time. Alternatively and with respect to terminations that are viewed as permanent, elastomeric materials such as silicon compounds, RTV synthetic rubber formulations may be injected as depicted in FIG. 10. In practice, the nozzle 142 should be forced against the cap following termination and dielectric material injected under pressure until it is seen to be flowing out the bottom of the assembly.

It is contemplated that the concept of filling the termination may be applied to the other embodiments of the invention connectors to be selectively used in applications wherein the termination interface will experience environmental stress. This typically applies in outside field applications which experience the presence of moisture, salt laden air, industrial fumes and the like. It is to be understood that the application of the elastomer is generally perceived not to be necessary in most interior applications involving electronic equipment, although thereto its use may be of avail to preclude reuse of the terminal and provide an added measure of electrical interface security.

Figure 11:
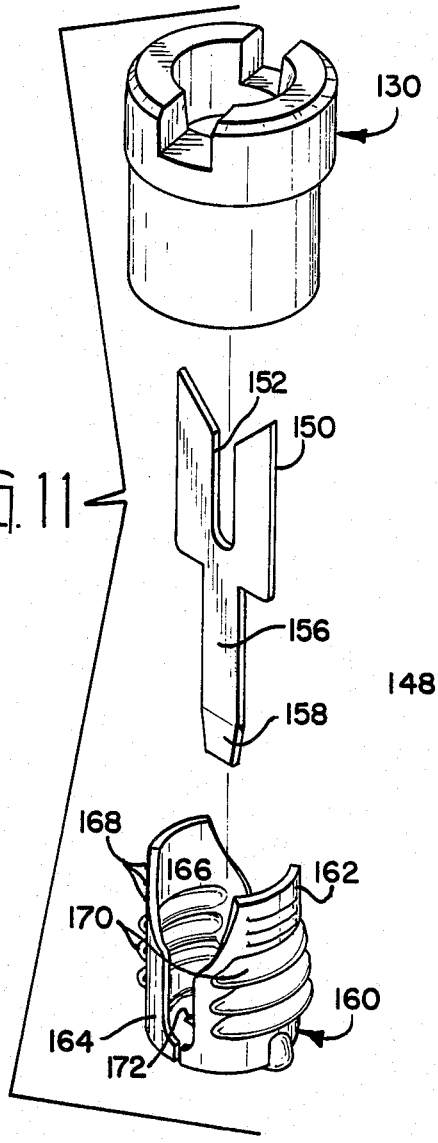
FIG. 11 is a perspective of a three part version of the invention connector exploded for clarity.

FIG. 11 shows an exploded view of an further alternative of the connector of the invention which is a three piece assembly 148 including an IDC element 150, a cap element 130, and a further tubular and threaded element 160.

The IDC element 150, which is stamped of conductive sheet material, includes wire receiving and stripping slot 152 opening out into a beveled portion 154 which tends to funnel and center a wire during insertion into slot 152. There is also included a projection 156 ending a tapered portion 158 which serves to connect a wire inserted within 150 to a printed circuit board trace as heretofore described.

The cap element 130 is essentially identical to the cap element described relative to FIG. 7 through 10 and contains the same features as there shown. The third element of the connector version 148 is shown as element 160, which is similar to the element 110 revealed in FIGS. 7–10. It is, however, without the conductor portion 122, that function being provided by the post portion 156 of the IDC terminal 150. The element 160 is cup shaped or tubular to include projections 162 which engage the screw element cap 130, a lower base portion 164, and relieved portions shown as 166, which allow the easy insertion and movement of a wire through 160. The upper portions of 160 include a series of teeth 168, which engage the interior of screw cap element 130 to hold it in position prior to activation. The element 160 includes a series of threads 170 which operate in the manner heretofore described relative to the threads 118. In the base or floor of 160, there is provided a rectangular aperture 172 adapted to receive the insertion of the IDC terminal 150, the post portion 156 which is made to project therethrough. The IDC terminal 150 is preferably locked to element 160 as by staking, or embossments, or tangs, which engage the surfaces thereof.

Figure 12:
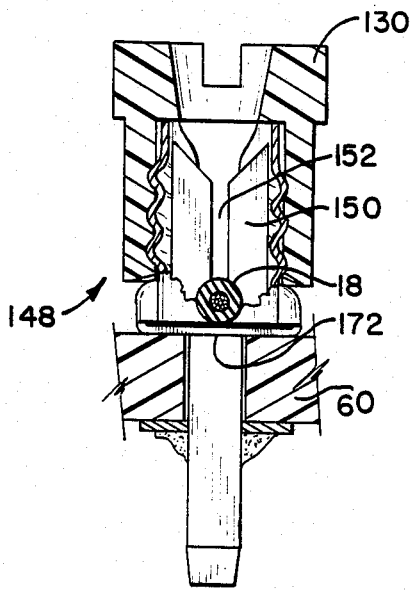
FIG. 12 is a view of the elements of FIG. 11 assembled and actuated to effect a wire termination.

In use, the connector 148 is inserted into a printed circuit board in the manner shown in FIG. 12, a conductor wire 18 inserted therewithin, and the cap screw element 130 pressed actually downwardly and rotated to drive the wire 18 into the slot 152 of IDC terminal 150. Thereafter, the interior may be filled in the manner indicated in FIG. 10 with a suitable dielectric material or not, depending upon the intended environment of use. The embodiment shown in FIGS. 11 and 12 is contemplated as an alternative which is better suited for the finer conductor wires, including the so called magnet, or formvar, wires in which event resort may be had to the aforementioned U.S. Pat. No. 4,116,522 and the details of that terminal.

It is contemplated that the several alternative embodiments and features herein described may be interchanged where practicable and desirable. For example, it is contemplated that in the embodiments of FIGS. 2–4C, suitable apertures may be made in the rod element 38 to allow for the injection of dielectric material. Or, alternatively, with respect to the embodiments of FIGS. 7–12, the screw cap elements may have threads molded therein with suitable formed, rather than self tapping, threads utilized in the mating element. If this is done, then the embodiments of FIGS. 11 and 12 may be modified so that the element 160 is molded of plastic, rather than stamped and formed of sheet metal, the electrical interface, in any event, being through the IDC terminal 150.

Having now disclosed and described our invention intending to enable a preferred practice thereof, we append the following claims:

We claim:

1. In a system for providing electrical interconnection of wires of different sizes to electronic devices, the combination comprising;

a plurality of electrical terminals of conductive material, each terminal having a threaded surface and a tubular portion including a wire receiving slot extending along said tubular portion, said slot having a tapering surface to engage a corresponding wire inserted therein and to displace insulation of said wire and to deform said wire, a relatively narrow portion of each said slot engaging a relatively smaller wire, and a relatively broad portion of each said slot engaging a relatively larger wire, each of a plurality of screw means having threading adapted to engage the threaded surface of a corresponding terminal, each corresponding screw means being adapted for manual rotation, with corresponding threading engaging a corresponding threaded surface and effecting a vertical and downward displacement of the corresponding screw means, said screw means having corresponding wire engaging surfaces for engaging corresponding wires and for pushing said wires along corresponding said slots, the wire engaging surfaces being located at different lengths along corresponding said screw means for providing different displacements of corresponding wires along corresponding slots.

2. The system of claim 1 wherein at least one said threaded surface is defined exteriorly of said tubular portion and at least one said threading of a corresponding screw means is defined interiorly thereof.

3. The system of claim 1 wherein at least one said threaded surface is defined interiorly of said tubular portion and at least one said threading of a corresponding screw means is defined exteriorly thereof.

4. The system of claim 1 wherein said screw means and wire engaging surfaces of the screw means are constructed to effect a substantial increase in the force required to rotate each said screw means, thereby effectively bottoming a corresponding screw means to provide a tactile feel by which a limit displacement of a corresponding wire in a corresponding slot.

5. An electrical interconnection device for terminating electrical wire comprising in combination;

an electrical terminal formed of conductive material to include a wire receiving slot adapted to strip an electrical wire inserted therein and to deform said wire to effect a tight, low resistance connection therewith, tubular threaded means affixed to said terminal and a cap means adapted to engage said tubular threaded means and upon rotation and engagement therewith, drive said wire into said slot to effect a termination therewith, and said tubular threaded means includes self-tapping threaded surfaces adapted to engage and cut into the interior of said cap means to lock said cap means in position on said tubular threaded means.

6. The combination of claim 5 wherein said cap means includes an aperture adapted to receive an insulating and dielectric medium injected through said cap means through the interior of said tubular means to exclude air from the internal volume thereof and surround and support and seal said wires terminated in said slot.

7. The combination of claim 5 and further including, means for admitting an insulating medium flowed within said tubular threaded means to effect sealing of the connection therewithin.

* * * * *